US008281708B2

(12) United States Patent
Kowlessar

(10) Patent No.: US 8,281,708 B2
(45) Date of Patent: Oct. 9, 2012

(54) SIP AND DIP COOKIE APPARATUS

(76) Inventor: David S. Kowlessar, Alexandria, VA (US)

( * ) Notice: Subject to any disclaimer, the term of this patent is extended or adjusted under 35 U.S.C. 154(b) by 1062 days.

(21) Appl. No.: 12/014,176

(22) Filed: Jan. 15, 2008

(65) Prior Publication Data

US 2009/0056560 A1 Mar. 5, 2009

Related U.S. Application Data

(60) Provisional application No. 60/968,552, filed on Aug. 28, 2007.

(51) Int. Cl.
*B65D 6/28* (2006.01)
*B65D 8/18* (2006.01)
*A47G 21/18* (2006.01)

(52) U.S. Cl. ..... 99/426; 220/4.22; 220/705; 239/33

(58) Field of Classification Search ..... 99/426, 99/440; 239/33; 220/4.22, 4.25, 4.24, 705; 248/333, 324, 326
See application file for complete search history.

(56) References Cited

U.S. PATENT DOCUMENTS 2,370,931 A * 3/1945 Bogin et al. ..... 62/293
4,211,024 A 7/1980 Nickell
D297,202 S 8/1988 Zumwalt
6,056,206 A 5/2000 Whiton
6,502,714 B1 * 1/2003 Lei ..... 220/709
6,503,222 B2 * 1/2003 Lo ..... 604/77
6,565,899 B1 5/2003 Cecere
D519,004 S 4/2006 Archer
7,090,269 B2 8/2006 Kelsey
7,552,674 B1 * 6/2009 Cotter ..... 99/426
2001/0054618 A1 12/2001 Ferrari
2004/0084912 A1 5/2004 Palmieri
2004/0244596 A1 12/2004 Ogline
2005/0012350 A1 * 1/2005 Kelsey ..... 294/118
2005/0109222 A1 5/2005 Swenson
2006/0096872 A1 5/2006 Oakes
2007/0095686 A1 5/2007 DeGroote

* cited by examiner

*Primary Examiner* — Reginald L Alexander
(74) *Attorney, Agent, or Firm* — Hoang Steve Ngo

(57) ABSTRACT

A sip and cookie dipper apparatus. The sip and cookie dipper apparatus is made up of a straw holder, a detachable cookie holder, and a cookie holder attachment mechanism. The straw holder defines a through bore with open opposite ends. At least one straw stabilizing member is located inside the through-bore. The cookie holder attachment mechanism is attached to the bottom end of the straw holder and is used to reversibly attach the detachable cookie holder to the straw holder. In one embodiment, the detachable cookie holder includes first and second outer slots and a central slot, wherein removable side-inserts fit into the first and second outer slots. Optional images of interest are disposed on the side-inserts. In another embodiment, detachable cookie holder is a one-piece detachable cookie holder lacking first and second outer slots and the central slot, and has permanent sides in place of removable side-inserts.

25 Claims, 10 Drawing Sheets

SIP AND DIP COOKIE APPARATUS

CROSS-REFERENCE TO RELATED APPLICATIONS

This application claims the benefit of priority from U.S. Provisional Patent Application Ser. No. 60/968,552 (filed Aug. 28, 2007).

STATEMENT REGARDING FEDERALLY SPONSORED RESEARCH OR DEVELOPMENT

Not Applicable.

FIELD OF THE INVENTION

The present invention relates to cookie dippers and more particularly to a sip and dip cookie apparatus designed to work with a straw.

BACKGROUND OF THE INVENTION

Dunking cookies into milk can be a somewhat messy undertaking. The child or adult dunking a cookie into a container such as a tumbler or cup type container filled with milk can easily contact their fingers directly with the milk held in the container. To avoid contact with the milk held in the container the person ("the dunker") doing the dunking is obliged to keep part of the cookie out of the milk. Even when the dunker keeps part of the cookie out of the milk the cookie can fall apart as it absorbs the milk from the container leading to a further mess especially if the dunker then uses his fingers to pick out the remnants of the cookie from the container. Thus, there is a need for a device or apparatus that is easy to use and which allows a dunker to immerse the whole cookie in the milk without risk of loosing the cookie.

SUMMARY OF THE INVENTION

A sip and cookie dipper apparatus. The sip and cookie dipper apparatus is made up of a straw holder, a detachable cookie holder, and a cookie holder attachment mechanism. The straw holder defines a through bore with open opposite ends. At least one straw stabilizing member is located inside the through-bore. The cookie holder attachment mechanism is attached to the bottom end of the straw holder and is used to reversibly attach the detachable cookie holder to the straw holder. In one embodiment, the detachable cookie holder includes first and second outer slots and a central slot, wherein removable side-inserts fit into the first and second outer slots. Optional images of interest are disposed on the side-inserts. In another embodiment, detachable cookie holder is a one-piece detachable cookie holder lacking first and second outer slots and the central slot, and has permanent sides in place of removable side-inserts.

BRIEF DESCRIPTION OF THE DRAWINGS

Similar reference characters denote corresponding features consistently throughout the attached drawings.

DETAILED DESCRIPTION OF THE INVENTION

This invention is directed to cookie dippers and more particularly to a sip and cookie dipper apparatus designed to work with a straw. The sip and dip cookie apparatus of the present invention is denoted generally by the numeric label "100". A child or adult can use the sip and dip cookie apparatus 100, which can be made out of any suitable material such as plastic.

Referring to the Figures in general, the sip and dip cookie apparatus 100 of the present invention comprises a straw holder 120 and a detachable cookie holder 140. The straw holder 120 also serves as a handle, i.e., a user such as a child can hold the sip and dip cookie apparatus 100 by gripping the straw holder 120. The straw holder 120 includes front face 130. The straw holder 120 can have any suitable cross-section shape such as, but not limited to: a circular, semi-circular, rectangular or polygonal (regular or irregular polygonal) cross-section shape. The cross-section shape of the straw holder 120 is expressly not limited to the cross-section shape shown in any of the figures.

Figure 1:
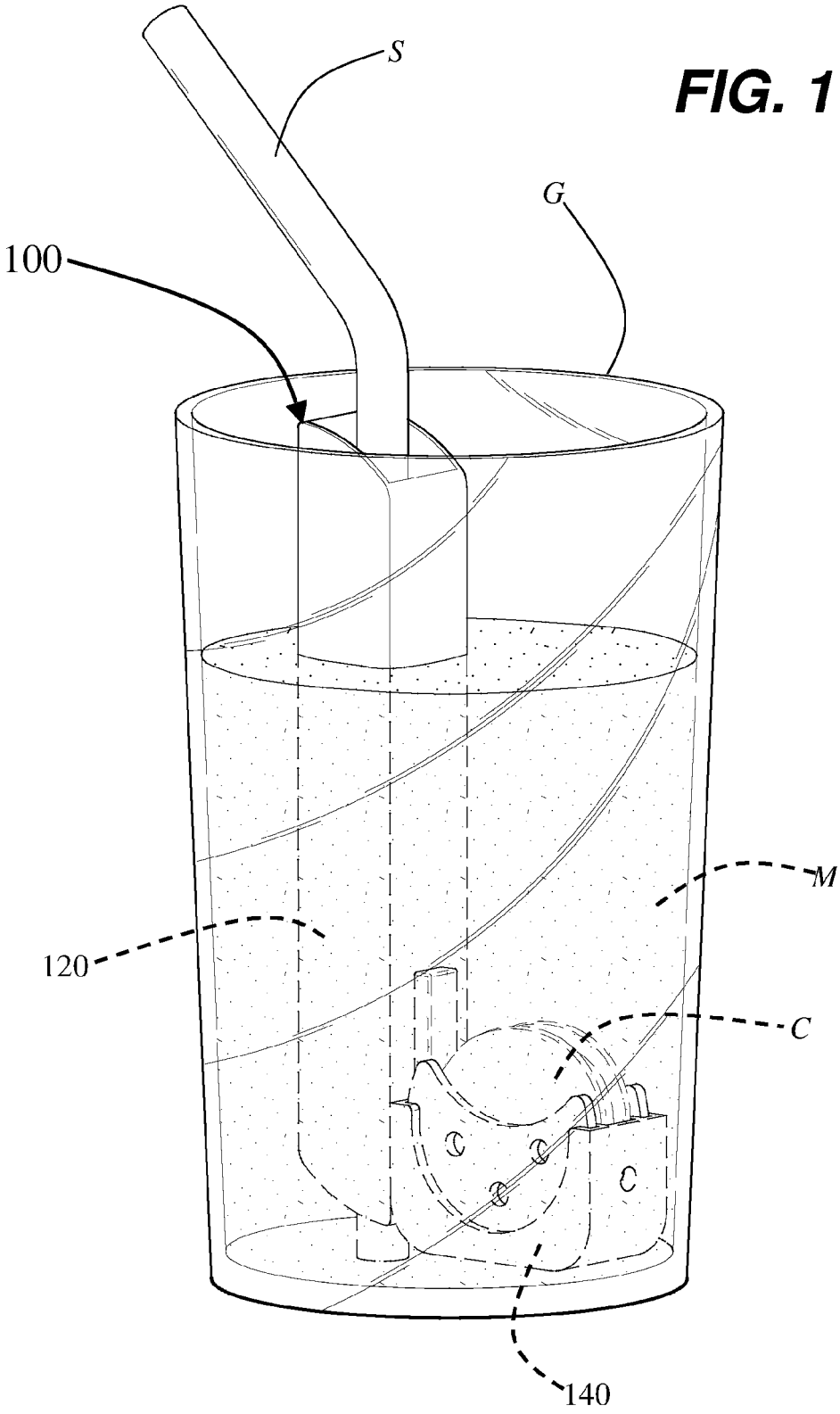
FIG. 1 shows a perspective environmental view of a sip and dip cookie apparatus according to the present invention.

Referring to FIG. 1, the sip and dip cookie apparatus 100 is shown dunked in a glass G of milk M. A straw S is shown fitted inside the straw holder 120, and a cookie C is shown disposed inside detachable cookie holder 140. During ordinary use of the sip and dip cookie apparatus 100 a cookie C is placed inside the detachable cookie holder 140, and the sip and dip cookie apparatus 100 is dunked (i.e., lowered) into a container, such as a glass G or beaker (not shown) of milk M. A child or adult can sip milk M via straw S while a cookie M rests in the detachable cookie holder 140. The cookie C will absorb milk while in the detachable cookie holder 140. With regular use a child or adult will learn, without undue effort or experimentation, the time required to sufficiently dunk the cookie M to the satisfaction of the child or adult user without the cookie M disintegrating immediately upon removing the cookie M from the detachable cookie holder 140.

Figure 2:
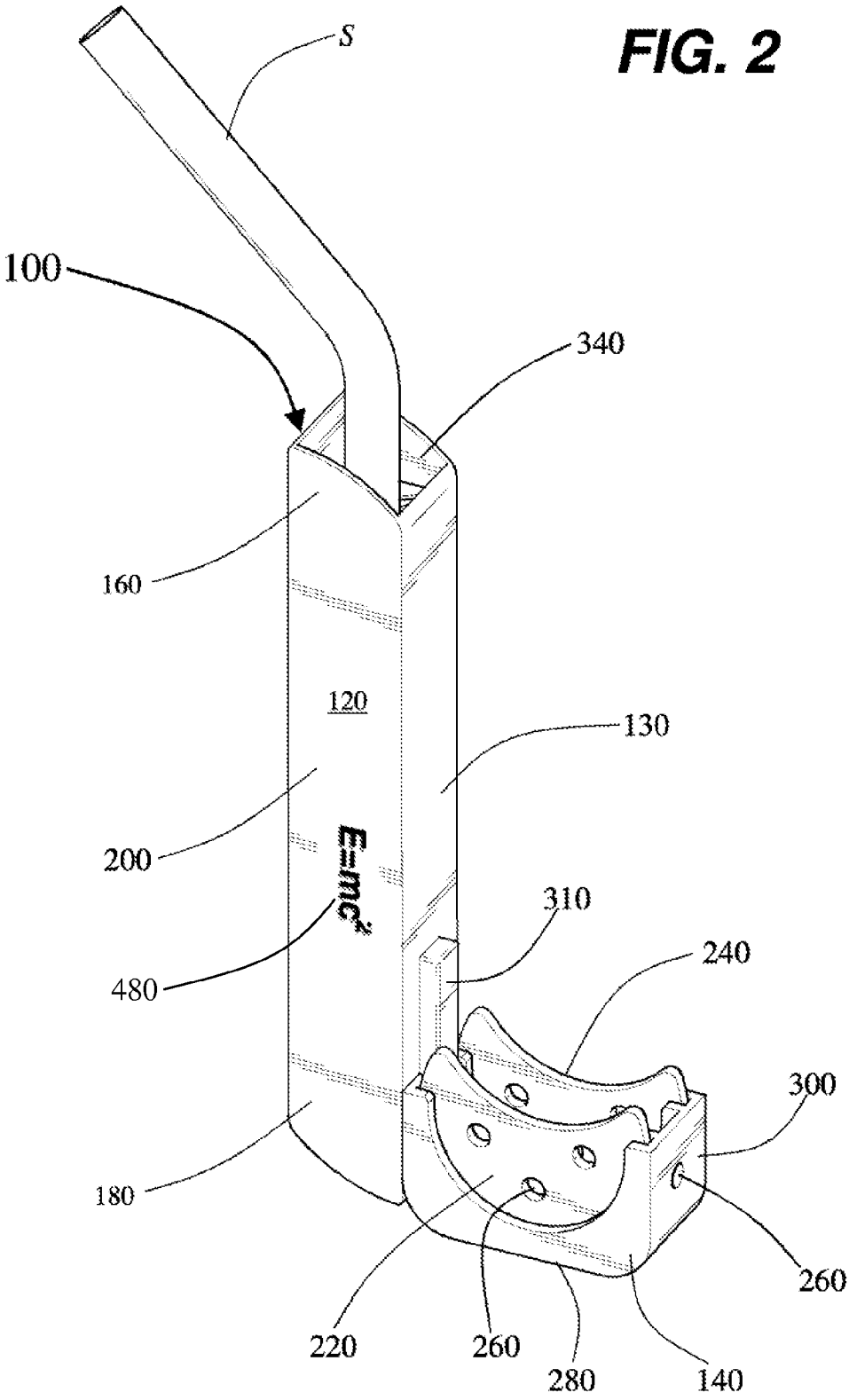
FIG. 2 shows a perspective view of a sip and dip cookie apparatus according to the present invention.

FIG. 2 shows a perspective view of the sip and dip cookie apparatus 100. The straw holder 120 respectively defines top and bottom opposite ends 160 and 180 with a mid-portion 200 located between the top and bottom ends 160 and 180. The detachable cookie holder 140 includes at least one side-insert; the at least one side-insert is represented in FIG. 2 by first and second side inserts 220 and 240, respectively. The side-inserts 220 and 240 help keep the cookie C inside the detachable cookie holder 140 and provide a surface on which images can be displayed (also see, for example, FIG. 7).

Optional indicia 480, which can take the form of images, drawings or writings, can be disposed on the straw holder 120 or on any other location such as on side inserts 220 and 240;

the optional indicia can be can take the form of educational indicia or images, such as letters of the alphabet or physics formula such as, but not limited to, $E=mc^2$ (Einstein's famous energy-mass equation), y=mx+c (the straight-line graph equation), force=mass*acceleration that can be written as f=ma (Sir Isaac Newton's famous motion equation), "2a=8, a=?", which is the algebraic version of "2 apples equals 8 cents, how much does 1 apple cost?", etc. Other non-limiting examples of indicia 480 are chemical symbols (such as, but not limited to, Periodic Table element symbols, molecular formulas such as "Water is known as $H_2O$".

Figure 6:
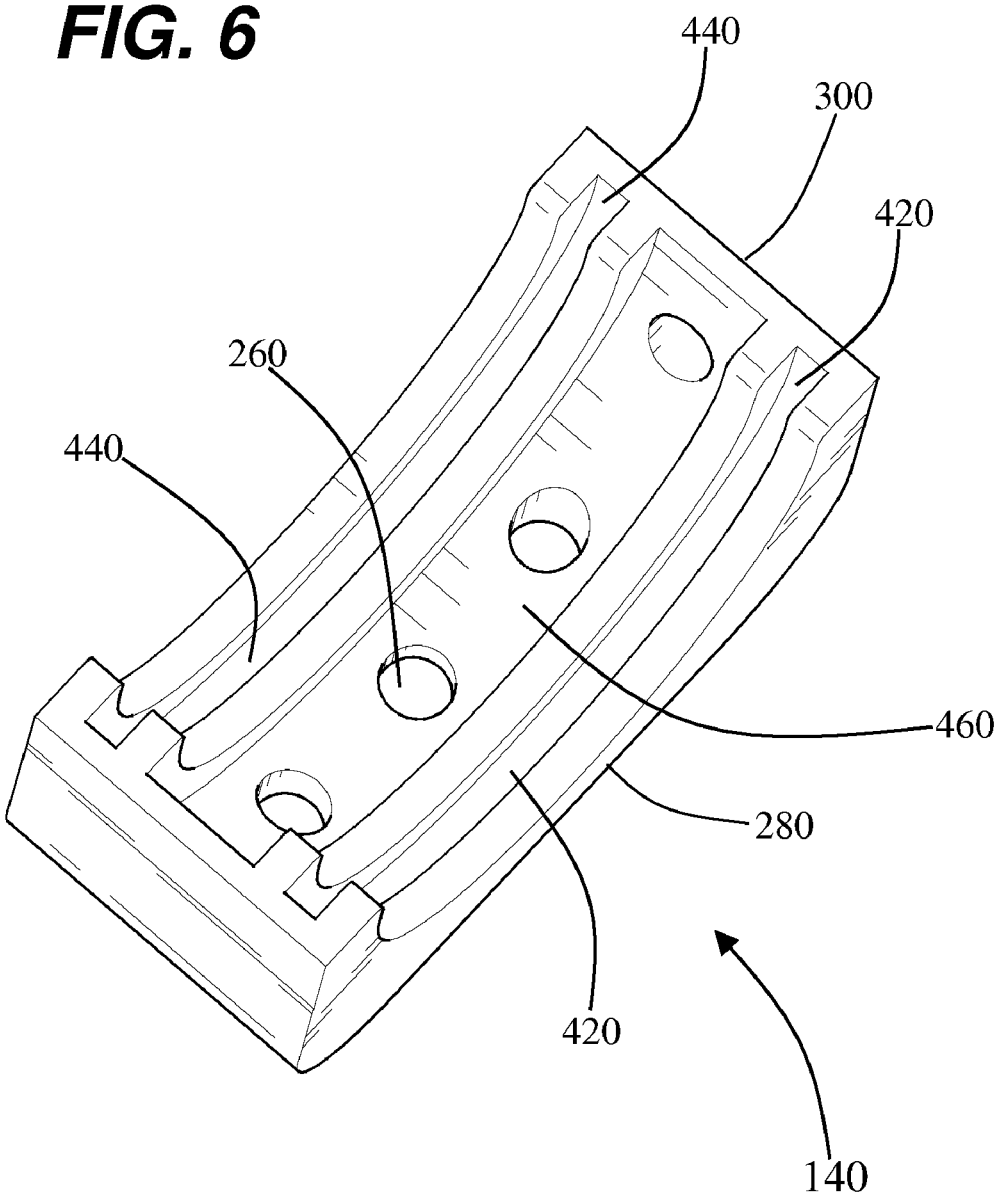
FIG. 6 shows an elevated view of a component for holding a cookie according to the present invention.

Still referring to FIG. 2, the detachable cookie holder 140 defines bottom surface 280 and front end 300. Optional through-milk drainage apertures 260 are located at any suitable point on the detachable cookie holder 140. For example, FIG. 2 shows optional milk drainage through-apertures 260 disposed in the side-inserts 220 and 240 and front end 300. FIG. 6 shows at least one milk drainage through-aperture 260 disposed in the bottom 280 and front 300 of the detachable cookie holder 140. The detachable cookie holder 140 is attached to the bottom end 180 of the straw holder 120 by means of any suitable attachment mechanism such as a clip or hook arrangement.

Still referring to FIG. 2, a cookie holder attachment mechanism 310 is shown attached to the front face 130 of straw holder 120. The detachable cookie holder 140 is reversibly attached to the front face 130 by means of the cookie holder attachment mechanism 310. The cookie holder attachment mechanism 310 defines a proboscis male member 315 (see FIG. 4).

Figure 3:
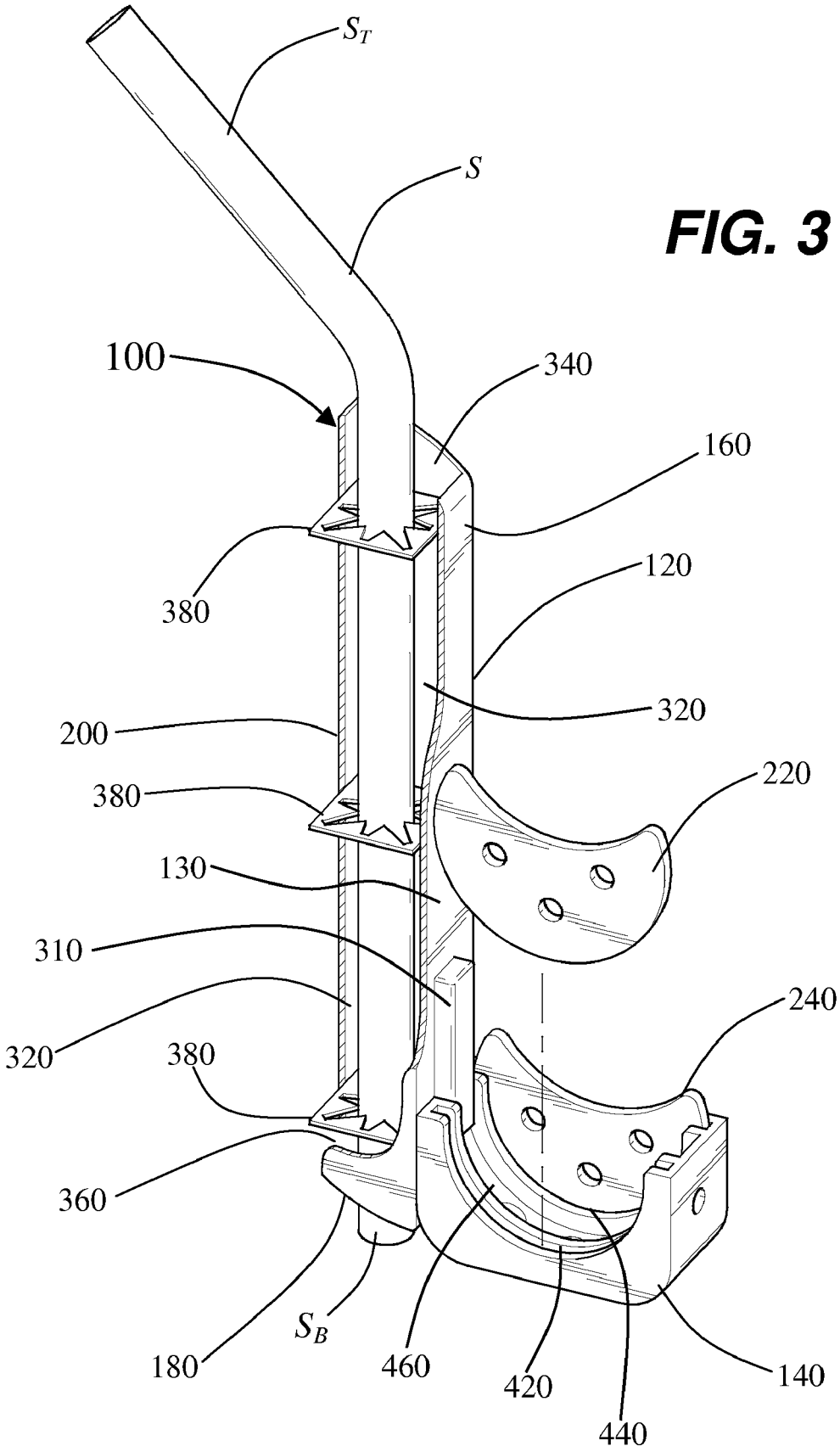
FIG. 3 shows a partial cutaway view of a sip and dip cookie apparatus according to the present invention.

FIG. 3 shows a partial cutaway view of a sip and dip cookie apparatus 100. The straw holder 120 includes a through-bore 320 with opposite top and bottom open ends 340 and 360, respectively. At least one straw stabilizing member 380 is located inside the through-bore 320.

The sip and dip cookie apparatus 100 can be supplied with a straw S already fitted through the straw holder 120. Alternatively, a straw S is inserted into and pushed through the through bore 320 of the straw holder 120 until the bottom end $S_B$ emerges from the bottom end 180 of the straw holder 120 (see FIG. 3).

Figure 4:
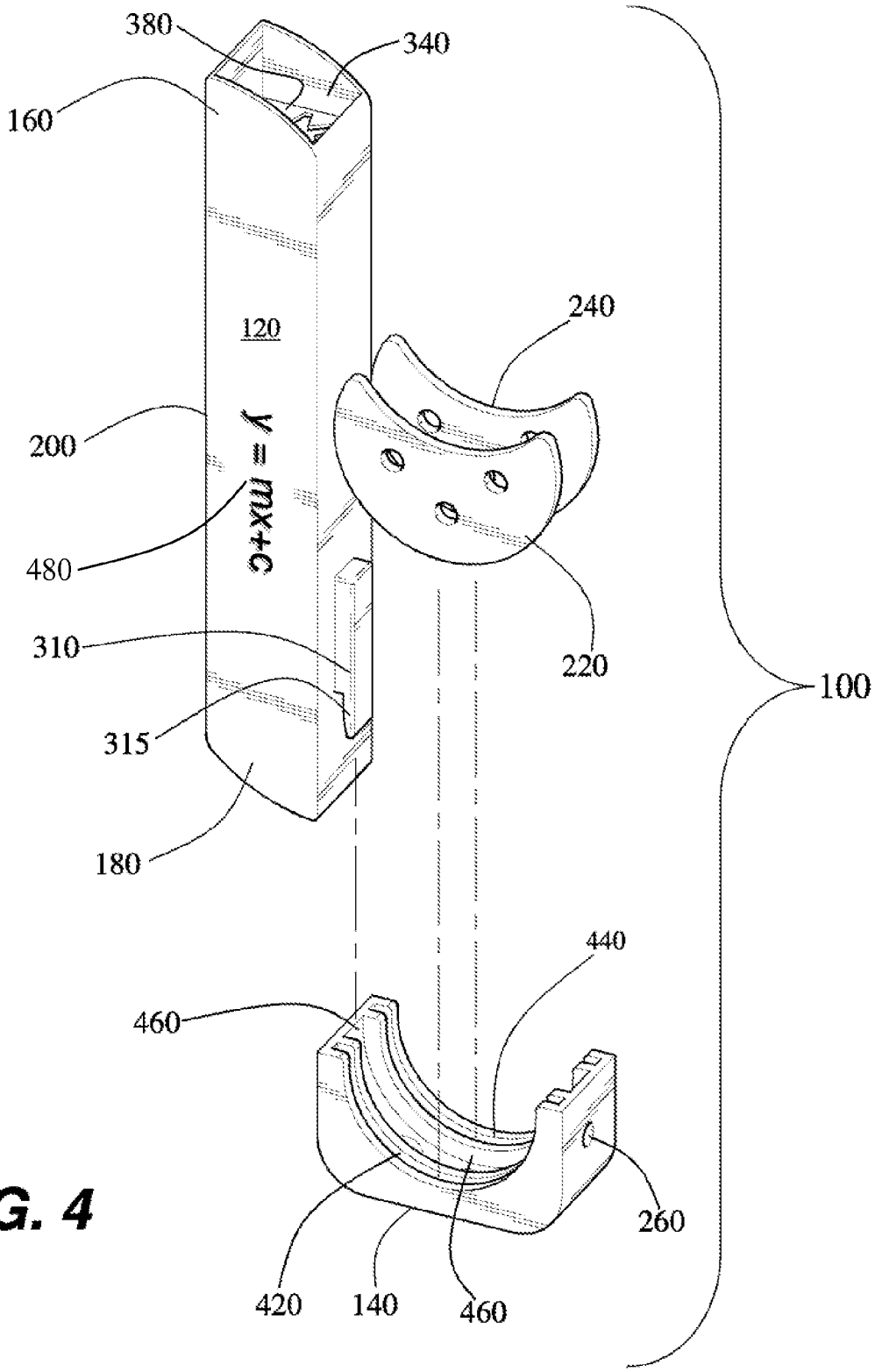
FIG. 4 shows an exploded view of the various components that make up a sip and dip cookie apparatus according to the present invention.

FIG. 4 shows an exploded view of the sip and dip cookie apparatus 100. The detachable cookie holder 140 respectively includes first and second outer slots 420 and 440; and a central slot 460. The first and second side-inserts 220 and 240 respectively slot into and out of the first and second outer slots 420 and 440. The central slot 460 is used to accommodate a cookie and provides the dual function of acting as a female slot with respect to the cookie holder attachment mechanism 310. The cookie holder attachment mechanism 310, and more particularly the proboscis male member 315, slots into the central slot 460 as shown in FIG. 4. The terms "central slot 460" and "center slot 460" are herein regarded as equivalent terms.

Figure 5:
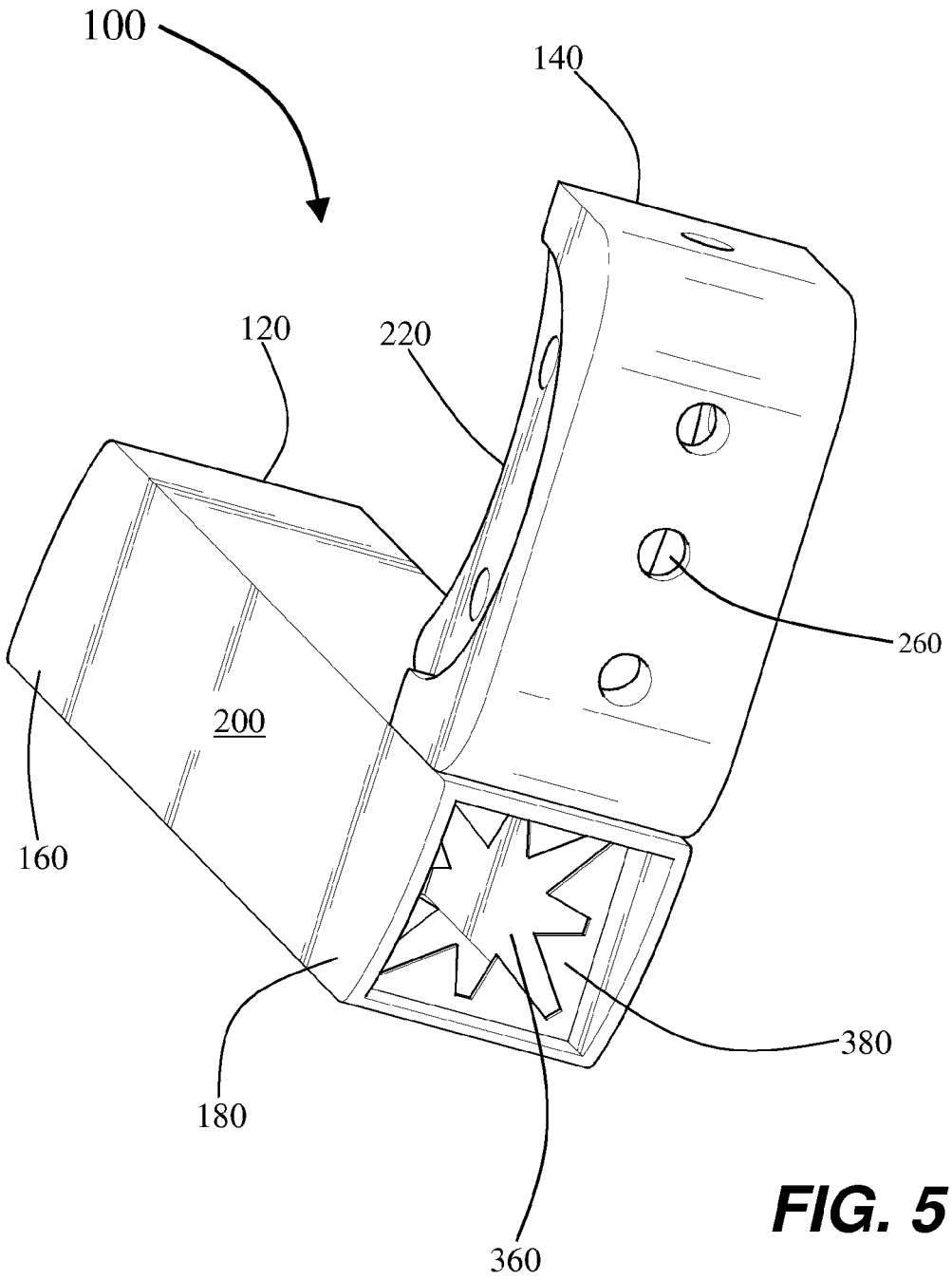
FIG. 5 shows a view from the bottom end of a sip and dip cookie apparatus according to the present invention.

FIG. 5 shows a view from the bottom end of the sip and dip cookie apparatus 100. Though not shown, during normal use of the sip and dip cookie apparatus 100, the bottom end $S_B$ of straw S would penetrate open end 360 of straw holder 120 to allow a user, such as a child, to sip milk through bottom end $S_B$ while a cookie C (not shown in FIG. 5) is being dunked while held in central slot 460.

FIG. 6 shows an elevated view of the detachable cookie holder 140 which clearly shows the first and second outer slots 420 and 440; and the central slot 460. The first and second side-inserts 220 and 240 respectively slot into and out of the first and second outer slots 420 and 440 (see FIG. 4). The central slot 460 is used to accommodate a cookie C (see FIG. 1) and also functions as a female slot with respect to the cookie holder attachment mechanism 310 (see FIGS. 2 and 4).

Figure 7:
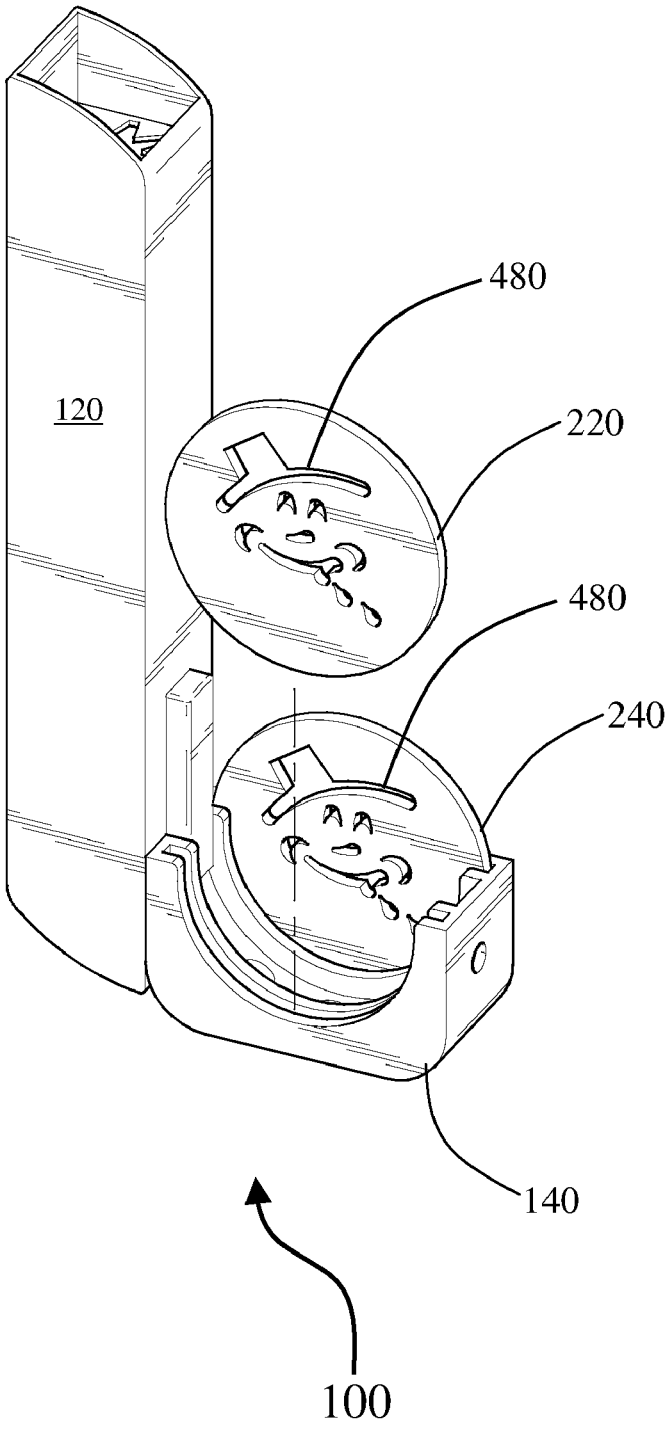
FIG. 7 shows an elevated side view of a sip and dip cookie apparatus according to the present invention.

Referring to FIG. 7, the first and second side-inserts 220 and 240 each have opposite sides. Optional indicia or drawings or figures 480 can be disposed on either side of the side-inserts 220 and 240. The optional indicia or drawings or figures 480 can take the form of educational indicia or images, such as letters of the alphabet or physics formula such as, but not limited to, $E=mc^2$. Alternatively, the side-inserts can have cutouts defining an image of interest to a child. The optional indicia or drawings or figures 480 can take any suitable form such as, but not limited to: company logos, cartoon images, actor likenesses (e.g., image of a film actor), images of sports heroes (such as well known baseball, football and/or basketball players), and indicia, alone or in combination.

In one embodiment, at least one of said first 220 and second 240 side-inserts include indicia or drawings or figures 480 in the form of at least one image selected from the group consisting of: a company logo, an image of a cartoon character, an image of a professional actor, an image of an Indy racing car, an image of an animal, an image of a soldier, an image of a computer game character, and an image of a professional sports star.

Figure 8:
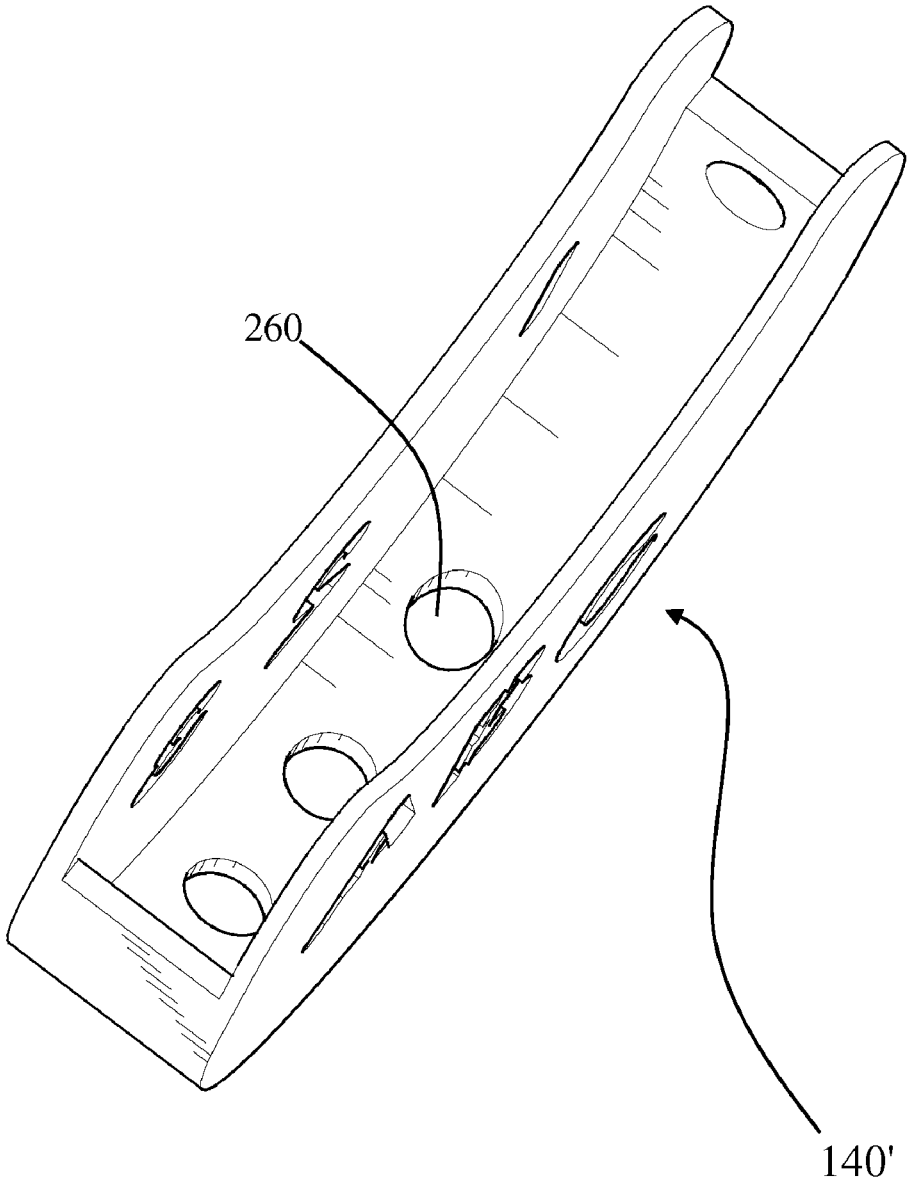
FIG. 8 shows an elevated view of a one-piece detachable cookie holder member according to the present invention.
Figure 9:
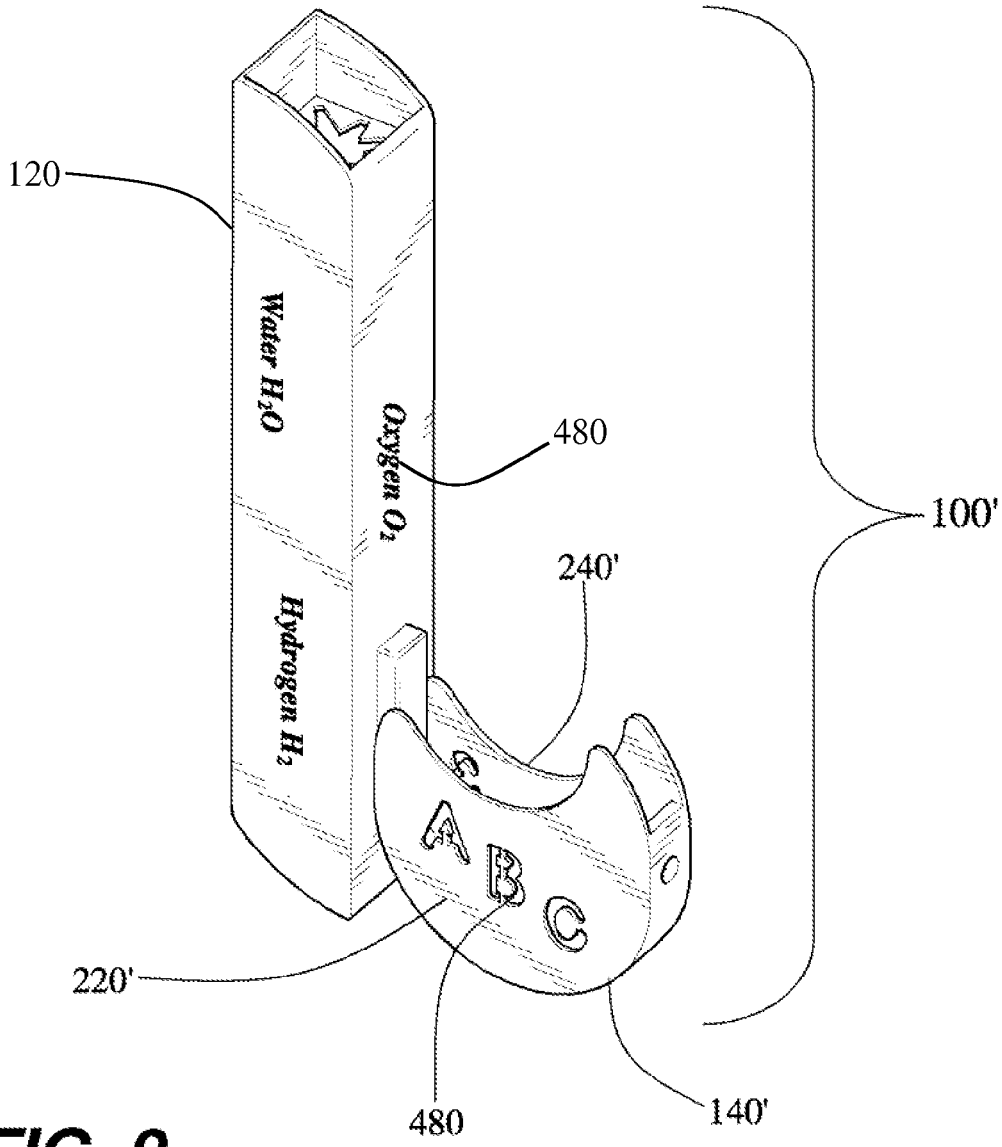
FIG. 9 shows the one-piece detachable cooking holder member of FIG. 8 attached to a straw holder member according to the present invention.
Figure 10:
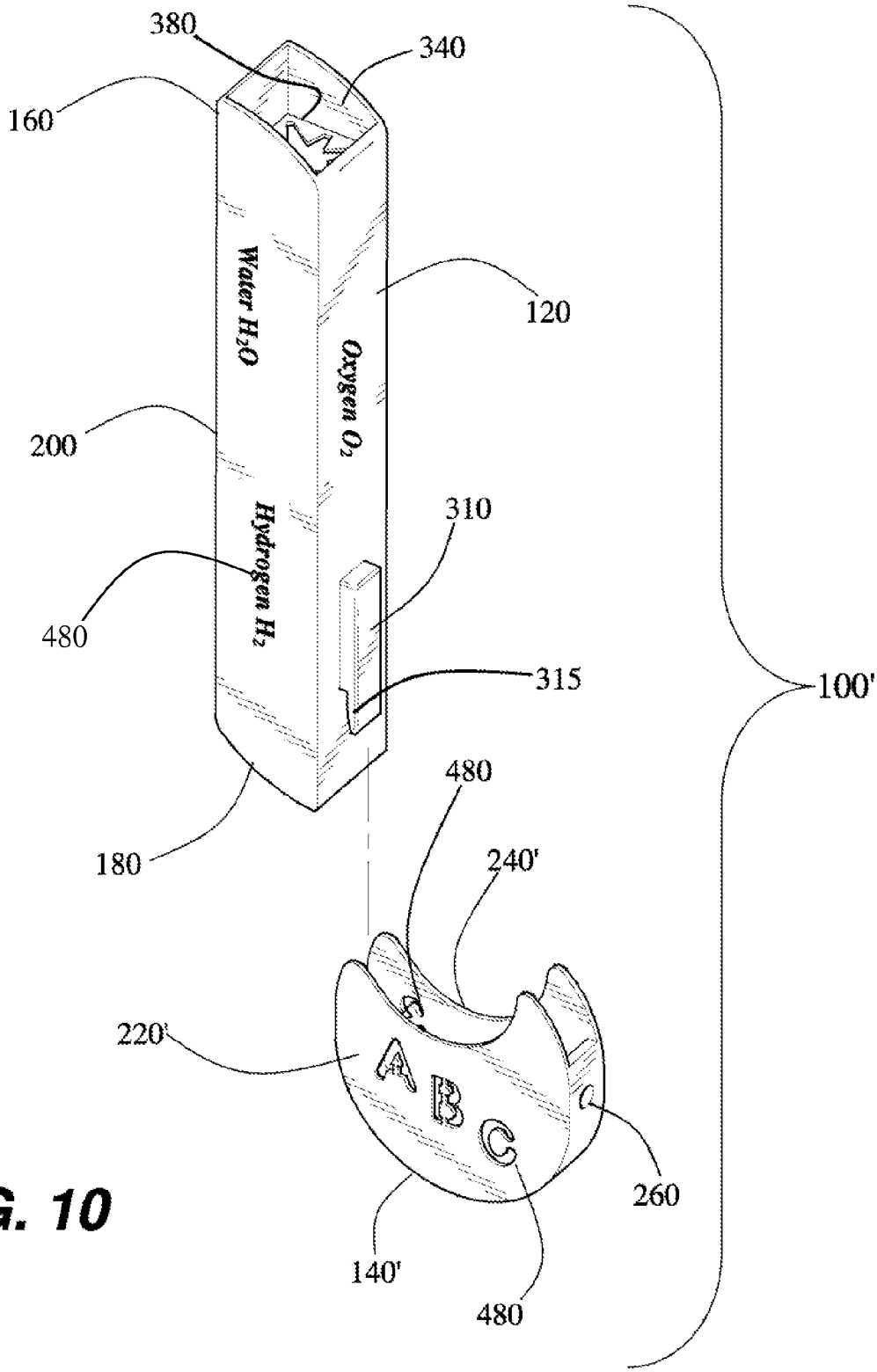
FIG. 10 shows an exploded view of a second embodiment of the present invention comprising the one-piece detachable cookie holder member of FIG. 8.

In a further embodiment, the detachable cookie holder 140 is a one-piece version (represented in FIGS. 8 through 10 as part number 140'); the one-piece detachable cookie holder 140' lacks: first and second outer slots 420 and 440, central slot 460, and side-inserts 220 and 240. Side-inserts 220 and 240 are replaced with permanently fixed sides 220' and 240'. The one-piece detachable cookie holder 140' can be attached and detached to the straw holder 120 as shown in FIG. 10. The sip and dip cookie apparatus fitted with the one-piece detachable cookie holder 140' is represented in FIGS. 9 and 10 by the label 100'. Optional indicia or drawings or figures 480 can be disposed on one or both sides 220' and 240' of the one-piece detachable cookie holder 140'. The optional indicia or drawings or figures 480 can take the form of educational indicia or images, such as letters of the alphabet or physics formula such as $E=mc^2$.

It is to be understood that the present invention is not limited to the embodiments described above, but encompasses any and all embodiments within the scope of the following claims.

I claim:

1. A sip and cookie dipper apparatus, comprising:

a straw holder, wherein said straw holder comprises a through bore with open opposite ends, and wherein said straw holder defines a chamber and top and bottom opposite ends;

a detachable cookie holder, wherein said cookie holder is attached to said straw holder, wherein said cookie holder is dimensioned for receiving a cookie from a user, wherein said cookie holder comprises at least one drainage aperture, wherein said cookie holder retains at least a substantial portion of the cookie when at least a substantial portion of the cookie and at least a substantial portion of said cookie holder are dipped into a liquid, and wherein said cookie holder permits at least a portion of the cookie to absorb a portion of the liquid when at least a substantial portion of the cookie and at least a substantial portion of said cookie holder are dipped into the liquid; and a cookie holder attachment mechanism, wherein said cookie holder attachment mechanism is attached about said bottom end of said straw holder, and wherein said cookie holder attachment mechanism is used for attaching said cookie holder to said straw holder.

2. The sip and cookie dipper apparatus of claim 1, wherein said straw holder further comprises at least one straw stabilizing member located inside said through bore.

3. The sip and cookie dipper apparatus of claim 2, wherein said detachable cookie holder comprises first and second outer slots, a central slot, and first and second side-inserts, and wherein said first and second side-inserts slot respectively into said first and second outer slots.

4. The sip and cookie dipper apparatus of claim 2, wherein said detachable cookie holder comprises first and second outer slots and a central slot, wherein said cookie holder attachment mechanism defines a proboscis male member, and wherein said proboscis male member slots into said central slot of said detachable cookie holder.

5. The sip and cookie dipper apparatus of claim 2, wherein said detachable cookie holder comprises first and second outer slots, a central slot, and first and second side-inserts, wherein said first and second side-inserts slot respectively into said first and second outer slots, and wherein said first and second side-inserts include an image disposed thereon.

6. The sip and cookie dipper apparatus of claim 2, wherein said detachable cookie holder comprises first and second outer slots, a central slot, and first and second side-inserts, wherein said first and second side-inserts slot respectively into said first and second outer slots, and wherein at least one of said first and second side-inserts include an image disposed thereon, and wherein said image is at least one image selected from the group consisting of: a company logo, an image of a cartoon character, an image of a professional actor, an image of an Indy racing car, an image of an animal, an image of a soldier, an image of a computer game character, and an image of a professional sports star.

7. The sip and cookie dipper apparatus of claim 1, wherein said detachable cookie holder comprises first and second outer slots and a central slot.

8. The sip and cookie dipper apparatus of claim 7, wherein said detachable cookie holder further comprises first and second side-inserts, and wherein said first and second side-inserts slot respectively into said first and second outer slots.

9. The sip and cookie dipper apparatus of claim 7, wherein said cookie holder attachment mechanism defines a proboscis male member, and wherein said proboscis male member slots into said central slot of said detachable cookie holder.

10. The sip and cookie dipper apparatus of claim 7, wherein said detachable cookie holder further comprises first and second side-inserts, wherein said first and second side-inserts slot respectively into said first and second outer slots, and wherein said first and second side-inserts include an image disposed thereon.

11. The sip and cookie dipper apparatus of claim 7, wherein said detachable cookie holder further comprises first and second side-inserts, wherein said first and second side-inserts slot respectively into said first and second outer slots, and wherein at least one of said first and second side-inserts include an image disposed thereon, and wherein said image is at least one image selected from the group consisting of a company logo, an image of a cartoon character, an image of a professional actor, an image of an Indy racing car, an image of an animal, an image of a soldier, an image of a computer game character, and an image of a professional sports star.

12. The sip and cookie dipper apparatus of claim 1, wherein said detachable cookie holder comprises a pair of opposing permanent sides and a bottom defined therebetween.

13. The sip and cookie dipper apparatus of claim 2, wherein said detachable cookie holder comprises a pair of opposing permanent sides and a bottom defined therebetween.

14. A sip and cookie dipper apparatus, comprising:

a straw holder, wherein said straw holder comprises a through bore with open opposite ends, and wherein said straw holder defines a chamber and top and bottom opposite ends; and a cookie holder, wherein said cookie holder is attached to said straw holder, wherein said cookie holder is dimensioned for receiving a cookie from a user, wherein said cookie holder comprises first and second outer slots, a central slot, and at least one drainage aperture, wherein said cookie holder retains at least a substantial portion of the cookie when at least a substantial portion of the cookie and at least a substantial portion of said cookie holder are dipped into a liquid, and wherein said cookie holder permits at least a portion of the cookie to absorb a portion of the liquid when at least a substantial portion of the cookie and at least a substantial portion of said cookie holder are dipped into the liquid.

15. The sip and cookie dipper apparatus of claim 14, wherein said cookie holder further comprises first and second side-inserts, and wherein said first and second side-inserts slot respectively into said first and second outer slots.

16. The sip and cookie dipper apparatus of claim 14, wherein said cookie holder further comprises first and second side-inserts, wherein said first and second side-inserts slot respectively into said first and second outer slots, and wherein said first and second side-inserts include an image disposed thereon.

17. The sip and cookie dipper apparatus of claim 14, wherein said cookie holder further comprises first and second side-inserts, wherein said first and second side-inserts slot respectively into said first and second outer slots, and wherein at least one of said first and second side-inserts include an image disposed thereon, and wherein said image is at least one image selected from the group consisting of: a company logo, an image of a cartoon character, an image of a professional actor, an image of an Indy racing car, an image of an animal, an image of a soldier, an image of a computer game character, and an image of a professional sports star.

18. A sip and cookie dipper apparatus, comprising:

a straw holder, wherein said straw holder comprises a through bore with open opposite ends and at least one straw stabilizing member located inside said through bore, and wherein said straw holder defines top and bottom opposite ends; and a cookie holder, wherein said cookie holder is attached to said straw holder, wherein said cookie holder is dimensioned for receiving a cookie from a user, wherein said cookie holder comprises at least one drainage aperture, wherein said cookie holder retains at least a substantial portion of the cookie when at least a substantial portion of the cookie and at least a substantial portion of said cookie holder are dipped into a liquid, and wherein said cookie holder permits at least a portion of the cookie to absorb a portion of the liquid when at least a substantial portion of the cookie and at least a substantial portion of said cookie holder are dipped into the liquid.

19. The sip and cookie dipper apparatus of claim 18, further comprising a cookie holder attachment mechanism, wherein said cookie holder attachment mechanism is attached about said bottom end of said straw holder, and wherein said cookie holder attachment mechanism is used for attaching said cookie holder to said straw holder.

20. The sip and cookie dpper apparatus of claim 19, wherein said detachable cookie holder comprises first and second outer slots and a central slot.

21. The sip and cookie dipper apparatus of claim 20, wherein said detachable cookie holder further comprises first and second side-inserts, and wherein said first and second side-inserts slot respectively into said first and second outer slots.

22. The sip and cookie dipper apparatus of claim 20, wherein said cookie holder attachment mechanism defines a proboscis male member, and wherein said proboscis male member slots into said central slot of said detachable cookie holder.

23. The sip and cookie dipper apparatus of claim 20, wherein said detachable cookie holder further comprises first and second side-inserts, wherein said first and second side-inserts slot respectively into said first and second outer slots, and wherein said first and second side-inserts include an image disposed thereon.

24. The sip and cookie dipper apparatus of claim 20, wherein said detachable cookie holder further comprises first and second side-inserts, wherein said first and second side-inserts slot respectively into said first and second outer slots, and wherein at least one of said first and second side-inserts include an image disposed thereon, and wherein said image is at least one image selected from the group consisting of: a company logo, an image of a cartoon character, an image of a professional actor, an image of an Indy racing car, an image of an animal, an image of a soldier, an image of a computer game character, and an image of a professional sports star.

25. The sip and cookie dipper apparatus of claim 19, wherein said detachable cookie holder comprises a pair of opposing permanent sides and a bottom defined therebetween.

* * * * *